US006397715B1

(12) United States Patent
Roberts

(10) Patent No.: US 6,397,715 B1
(45) Date of Patent: Jun. 4, 2002

(54) SLUG-RETAINING PUNCH PRESS TOOL

(75) Inventor: Jay W. Roberts, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/443,807

(22) Filed: Nov. 19, 1999

(51) Int. Cl.[7] ..... H01R 43/16; B26F 1/14; B21D 45/00

(52) U.S. Cl. ..... 83/149; 83/146; 83/164; 83/690; 83/685; 83/694; 83/942

(58) Field of Search ..... 83/136, 164, 618, 83/690, 694, 696, 697, 942, 123, 125, 126, 129, 685, 146, 620, 149; 72/326, 328

(56) References Cited

U.S. PATENT DOCUMENTS 3,358,538 A * 12/1967 Maceyka ..... 83/164
3,742,805 A * 7/1973 Ranieri ..... 83/662
4,516,450 A 5/1985 Shuttleworth ..... 83/146
4,543,865 A 10/1985 Kramski ..... 83/146
5,054,188 A 10/1991 Sabado ..... 29/564.6
5,098,863 A 3/1992 Dolezal et al. ..... 437/211
5,136,907 A * 8/1992 Bakermans et al. ..... 83/93
5,271,148 A * 12/1993 Desrochers et al. ..... 29/827
5,286,679 A 2/1994 Farnworth et al. ..... 437/209
5,452,635 A 9/1995 Ong ..... 83/133

* cited by examiner

*Primary Examiner*—Boyer Ashley
(74) *Attorney, Agent, or Firm*—Knobbe Martens Olson & Bear LLP

(57) ABSTRACT

A punch and die tool for cutting a slug from a sheet of material that is retained in the opening of the die and does not adhere to or follow the punch on its upward stroke, and a method for retaining a slug in a die, are disclosed. The die is formed with one or more irregularities or grooves on the edge of the die face so that the slug cut by the operation of the punch and die will have a burr on its edge. The burr causes the slug to lodge in the inside surface of the die and prevents the slug from following the punch on its upward stroke.

6 Claims, 8 Drawing Sheets

SLUG-RETAINING PUNCH PRESS TOOL

BACKGROUND OF THE INVENTION

1. Field of the Invention

This invention relates generally to a punch press tool, and, in particular, to an IC chip fabrication punch press tool capable of cutting and removing material of relatively small dimensions.

2. Description of the Related Art

A punch press is a device used to cut a hole of predetermined size in a workpiece, often sheet metal. (See FIG. 1.) A punch press typically consists of a punch 1 and a die 2, which are often fabricated from hardened steel or steel alloy. The end of the punch 1, called the punch face 3, and the edge of the opening 4 of the die are sharpened so that on the down stoke of the punch 1, the punch face 3 contacts and pushes through a workpiece 5 into the die opening, thereby cutting a hole in the workpiece 5 in the size and shape of the punch 1 and die 2. (See FIGS. 2–4.) The piece of sheet metal or other material that is cut from the workpiece during the operation of the punch press is called a "slug" 6.

"Slug-pulling" is a recurring problem in the operation of high-speed punch presses, particularly in the computer chip fabrication process. Slug-pulling refers to the tendency of a slug 6 to follow or adhere to the punch face 3 during the return stroke of the punch. 1 and to lodge at or near the plane of the workpiece 5 or die opening 4, thereby creating a variety of problems as the workpiece 5 is moved quickly past the punch 1 and die 2 in subsequent punching operations. Slug-pulling can reduce the efficiency of punch press operations, thereby resulting in reduced throughput, lower yields, and higher manufacturing costs.

Punch press manufacturers have adopted various means to retard or prevent slug-pulling. One solution involves carving a groove 7 in the inside surface of the die 2, with the groove 7 extending in the direction of movement of the reciprocating punch 1. (See FIG. 5.) The slug formed by such a die 2 will tend to become jammed against the inside surface of the die 2 and will not adhere to the punch face 3 as the punch 1 is retracted from the die 2. Because of the difficulty and expense involved in machining a groove 7 on the inside surface of the die 2, particularly a die 2 of relatively small dimensions, this solution has not proved satisfactory.

Another solution involves adding a protrusion 8 to the inside surface of the die 2, with the protrusion 8 extending toward the center of the die 2. (See FIG. 6.) A slug formed by such a die 2 will tend to be retained by the protrusion 8. Once again, because of the difficulty and expense involved in forming such a protrusion 8 on the inside surface of the die 2, particularly a die 2 with relatively small dimensions, this solution to the slug-pulling problem has not gained wide popularity.

SUMMARY OF THE INVENTION

Accordingly, it is a principle object and advantage of the present invention to overcome some or all of these limitations and to provide an improved slug-retaining punch press tool.

In accordance with one embodiment, the present invention comprises a punch press for removing dambars from the leadframe of an IC chip package. One or more irregularities are formed on the edge of the die face of the dambar die so that the dambar that is cut and removed by the operation of the punch press will have one or more burrs on its perimeter. In another embodiment, the edge of the die face has a plurality of irregularities. In still another embodiment, the irregularities are V-shaped grooves of specific dimensions. In yet another embodiment, two V-shaped grooves are formed symmetrically, at opposite edges of the die face.

In another embodiment, the present invention comprises a punch and die, the die having one or more irregularities at its opening perimeter so that the slug that is cut and removed by the operation of the punch press will have one or more burrs on its edge. In another embodiment, the opening perimeter of the die has a plurality of irregularities. In still another embodiment, the irregularities are grooves.

In another embodiment, the present invention comprises a punch and die that conform at all locations along their respective perimeters, except at one or more locations at which they do not conform. The locations at which they do not conform are shaped so that the slug that is cut and removed by the operation of the punch and die will have a burr on its perimeter.

In one embodiment, a method comprises forming a punch and die with an irregularity on the die face of the die, placing a sheet of material between the punch and die, pressing the punch through the material and into the opening of the die thereby cutting and removing a slug with a burr on its edge, retracting the punch from the die, and using the burr to prevent the slug from adhering to and following the punch as it is retracted from the die. In another embodiment, the method comprises forming a plurality of irregularities on the die face.

In another embodiment, a method comprises forming a punch and die with an irregularity on the die face of the die and employing the punch and die to cut a slug from a sheet of material with a burr on its edge so that the burr will prevent the slug from adhering to and following the punch as it is retracted from the die. In another embodiment, the method comprises forming a plurality of irregularities on the die face.

In another embodiment, a method comprises pressing a punch face through a sheet of material and forming a burr of the edge of the slug thereby cut from the material, which burr lodges against the smooth surface of the opening of the die and prevents the slug from adhering to and following the punch as it is retracted from the die. In another embodiment, the method comprises forming a plurality of burrs on the slug.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

DETAILED DESCRIPTION OF THE PREFERRED EMBODIMENT

The present invention involves a high-speed punch press tool, and a method of using a high-speed punch press tool, to remove dambars from a leadframe of an IC chip package and thereby to separate the leads of that IC chip package.

Figure 1:
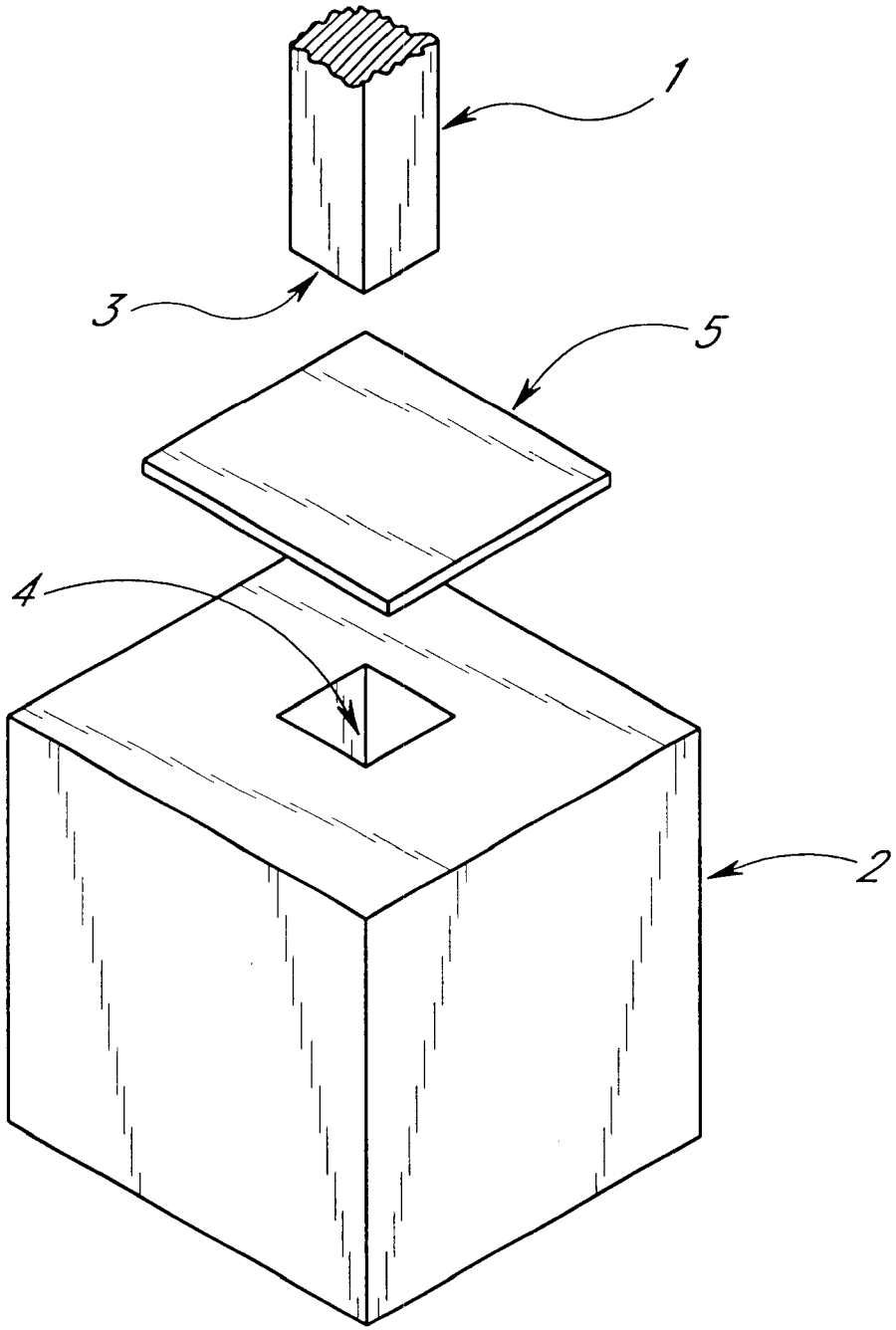
FIG. 1 (PRIOR ART)
FIG. 1 is a perspective view of a prior art punch and die.
Figure 2:
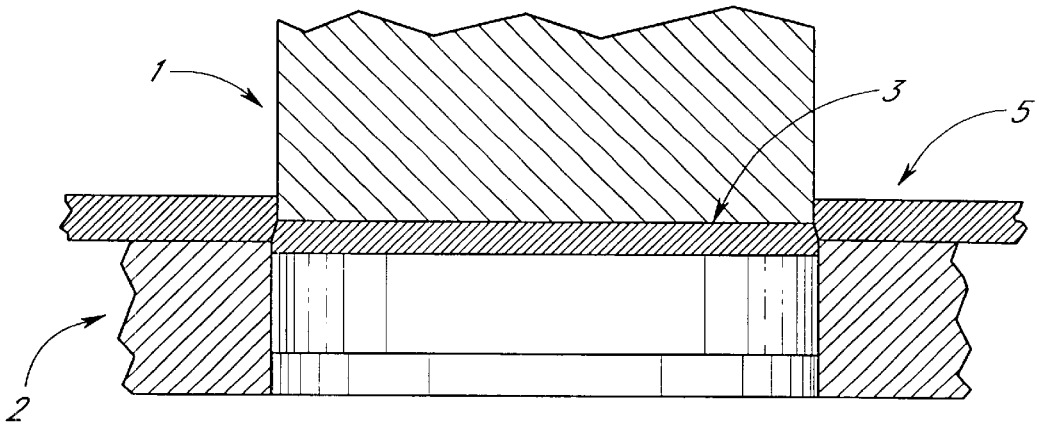
FIG. 2 (PRIOR ART)
FIG. 2 is a partially cut away, cross-sectional view of a prior art punch and die showing the punch as it enters a workpiece during a punching operation.
Figure 3:
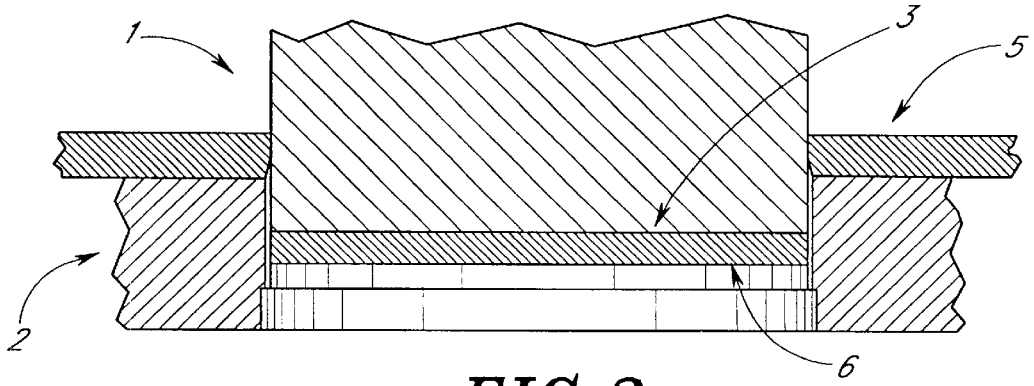
FIG. 3 (PRIOR ART)
FIG. 3 is a view of a prior art punch and die similar to that of FIG. 2, but showing the punch further extended into the die.
Figure 4:
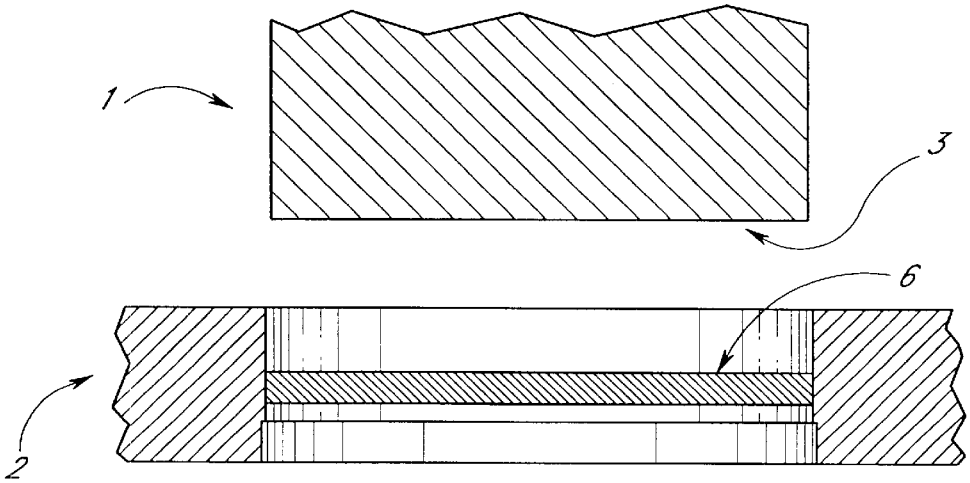
FIG. 4 (PRIOR ART)
FIG. 4 is a view of a prior art punch and die similar to that of FIGS. 2 and 3, but showing the punch retracted from the die and the slug retained therein.
Figure 5:
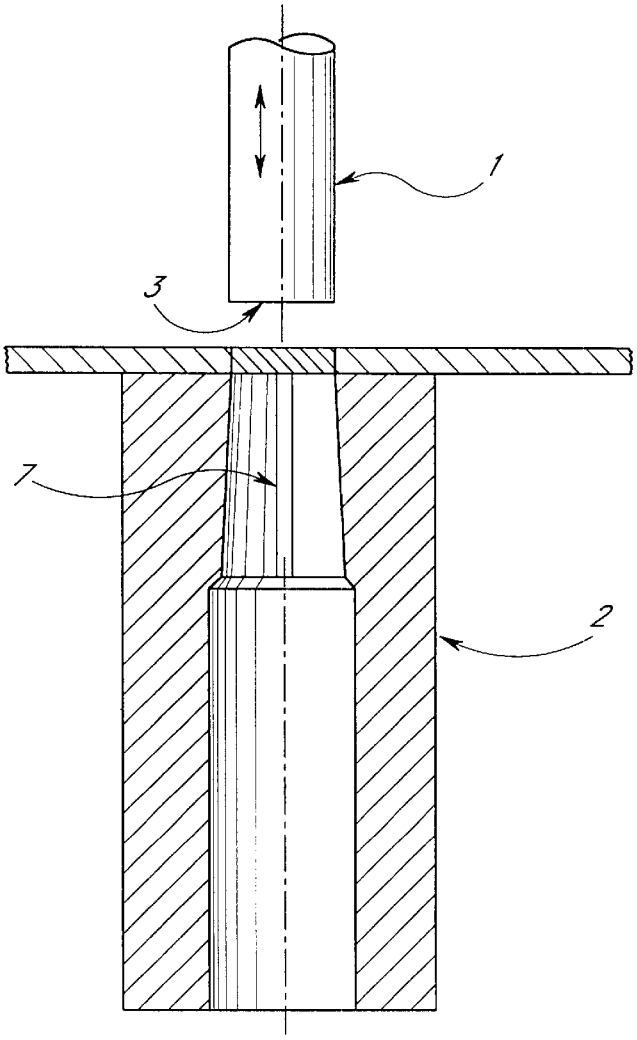
FIG. 5 (PRIOR ART)
FIG. 5 is a partially cut away, cross-sectional view of a prior art punch and die with a groove carved in the inside surface of the die.
Figure 6:
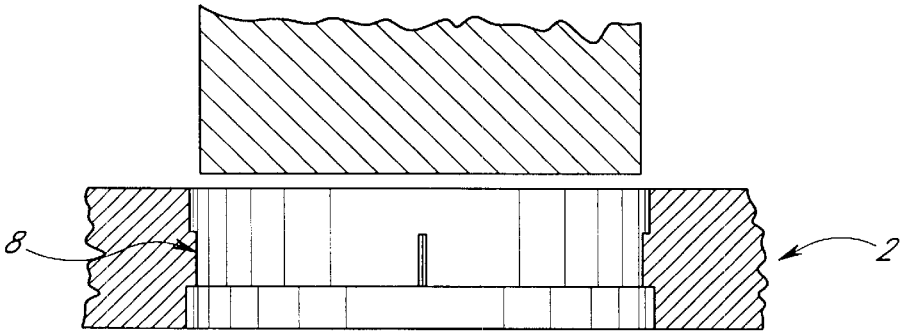
FIG. 6 (PRIOR ART)
FIG. 6 is a partially cut away, cross-sectional view of a prior art punch and die with a protrusion formed on the inside surface of the die.
Figure 7:
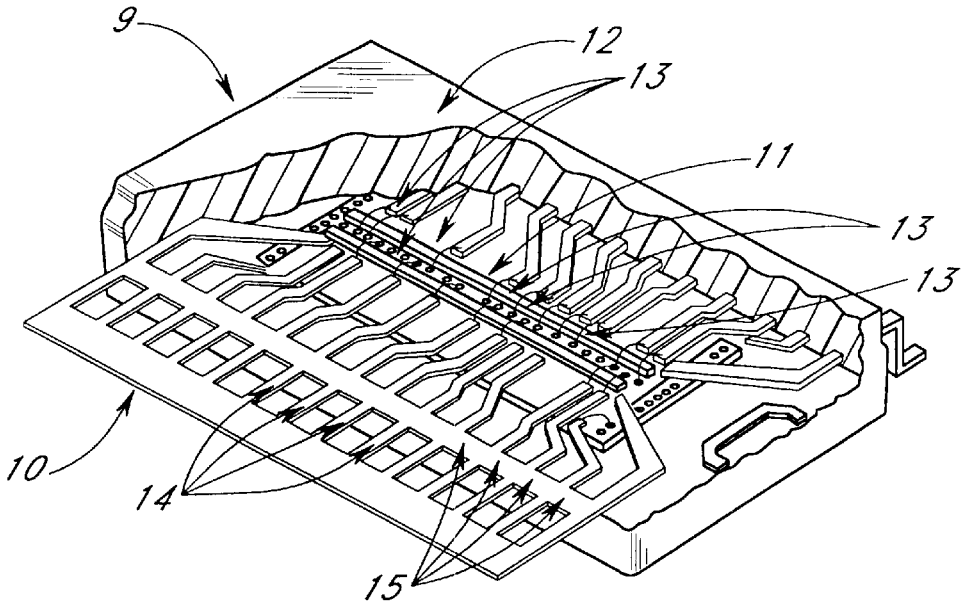
FIG. 7 is a partially cut away, perspective view of an IC chip package and leadframe.

FIG. 7 is a partially cut away view showing the configuration of an IC chip package 9 and a leadframe 10. The IC chip 11 within the IC chip package 9 contains the circuitry that defines and performs its electrical functions. The exterior body 12 of the IC chip package 9 is composed of plastic material formed by a method of transfer molding. The plastic exterior body 12 protects the sensitive and fragile circuitry of the IC chip 11. Wires 13 connect the circuitry of the IC chip 11 to individual conductive leads 14. The leads 14, in turn, connect the circuitry of the IC chip 11 to the outside environment. The plastic exterior body 12 fixes the arrangement of individual leads 14.

Figure 8:
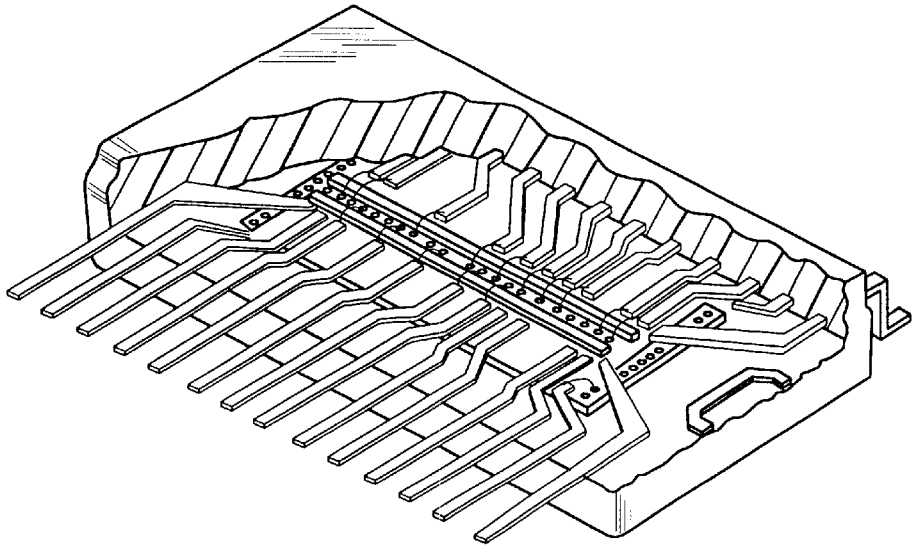
FIG. 8 is a view similar to that of FIG. 7, but showing the IC chip package after the leads have been separated.

The leadframe 10 is ordinarily constructed of a highly conductive material, typically metal, formed in thin sheets, that is receptive to bending and forming while maintaining structural integrity. The sheet thickness of the leadframe 10 defines the thickness of the leads 14. The leadframe 10 also defines the outer edges of the plastic exterior body 12 of the IC chip package 9 by means of structures 15 between the leads 14 that stop the flow of the liquid-phase polymer in the transfer molding process. Those structures 15 comprise dambars, and their placement between the leads 14 provides a contiguous strip of material along two sides of the IC chip package 9. The presence of, and necessity for, dambars 15 on the leadframe 10 during the transfer molding process yield the result that, at this stage, all leads 14 on each side of the IC chip package 9 are electrically connected. Embodiments of the present invention address the removal of the dambars 15 during the IC chip package fabrication process, thereby providing electrical isolation for each lead 14. FIG. 8 is a partially cut away view showing the IC chip package after the removal of the dambars.

Figure 9:
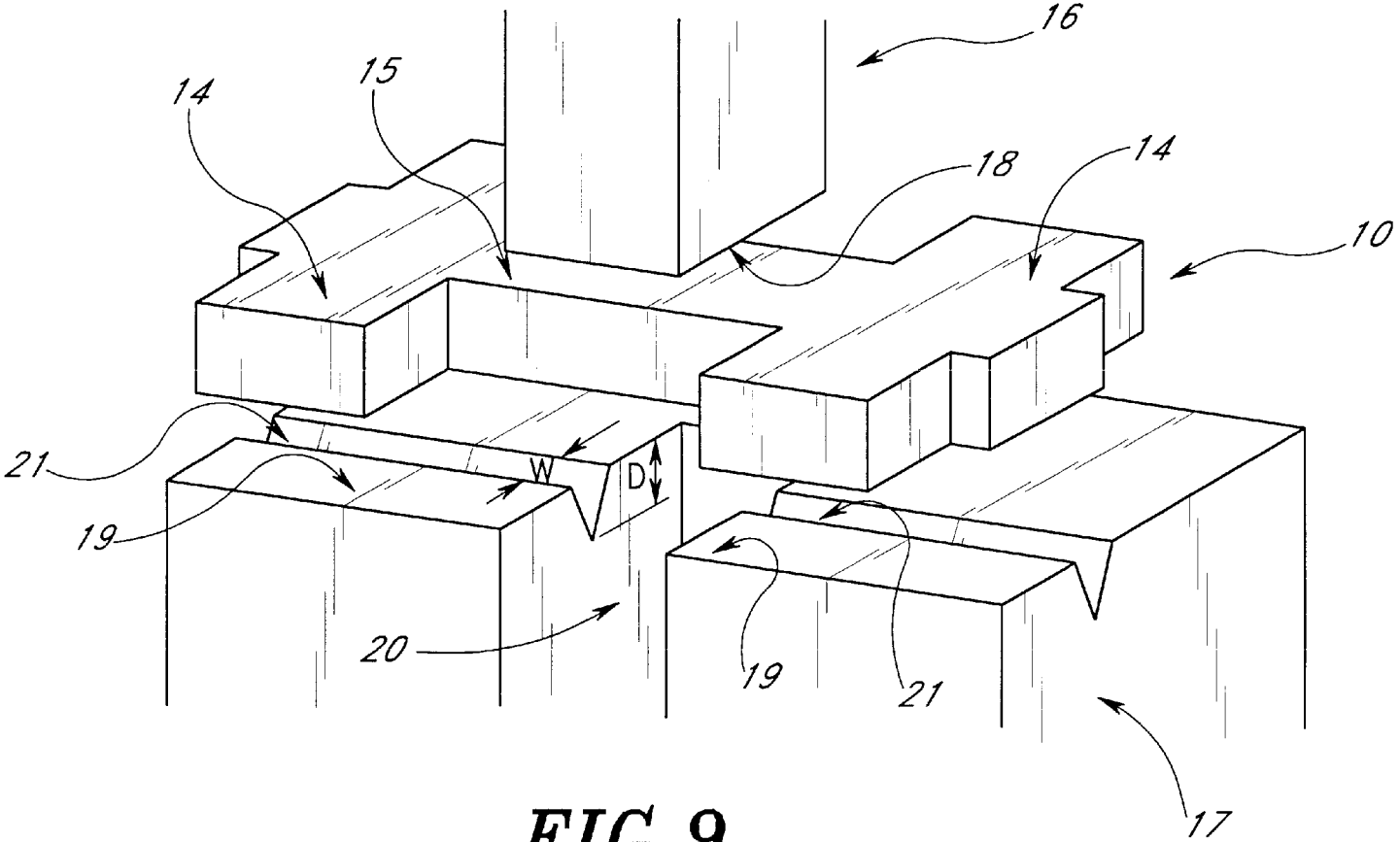
FIG. 9 is a perspective view of a punch and dambar die of the invention.

FIG. 9 is a perspective view of a punch 16 and a dambar die 17, which are fabricated from hardened steel with the punch face 18 and the die face 19 of the dambar die 17 having sharp edges. During a typical punching operation, a leadframe 10 is located over the die face 19 of the dambar die 17 and beneath the punch 16. The punch 16 is then pressed downwardly through the leadframe 10 and into the opening 20 of the dambar die 17, thereby cutting and removing the dambar 15 from the leadframe 10.

The die face 19 of the dambar die 17 is formed with one or more grooves 21 extending in a direction substantially perpendicular to the direction of movement of the reciprocating punch 16 and substantially perpendicular to the leads 14. In the preferred embodiment, the die face 19 of the dambar die 17 has two grooves 21 positioned on opposite sides of the die face 19, and each groove 21 is substantially V-shaped with a width "W" at the die face 19 of the dambar die 17 of approximately 0.10 millimeters and a depth "D" of approximately 0.09 millimeters. The grooves 21 are carved into the die face 19 of the dambar die 17 by a standard surface grinder using a properly dressed grinding wheel.

Figure 12:
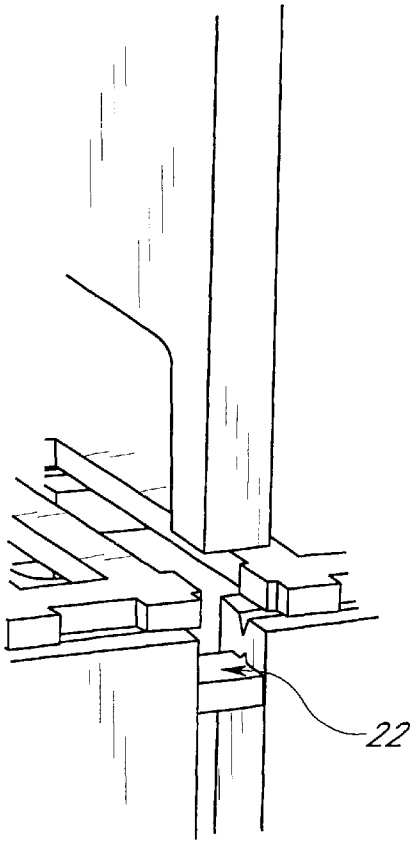
FIG. 12 is a view similar to that of FIGS. 10 and 11, but showing the punch retracted from the die and the slug retained therein.
Figure 11:
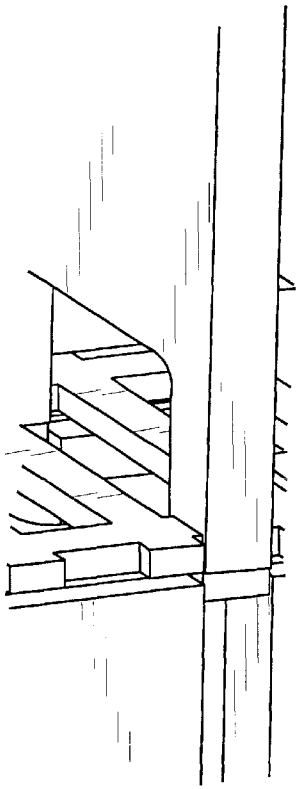
FIG. 11 is a view similar to that of FIG. 10, but showing the punch further extended into the die.
Figure 10:
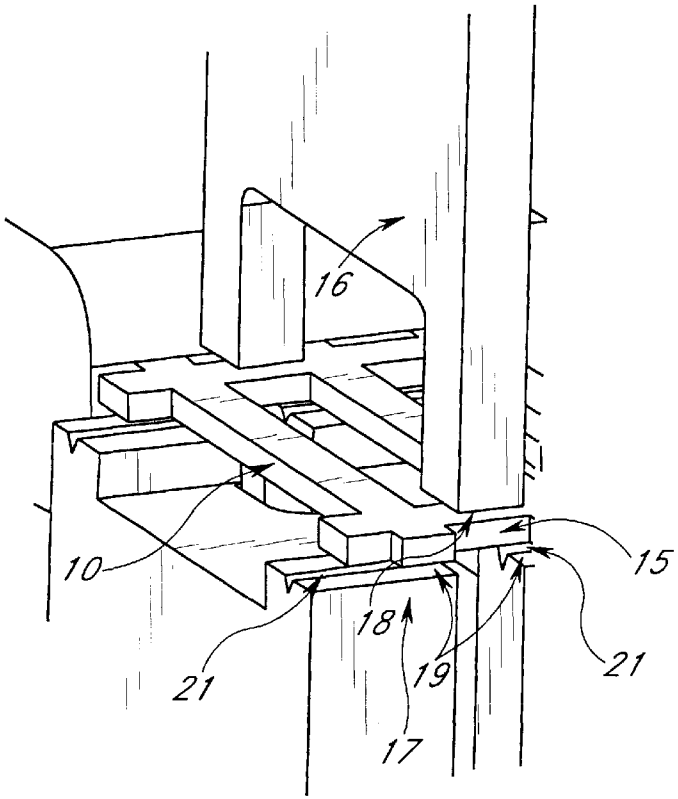
FIG. 10 is a perspective view of a punch and die of the invention showing the punch as it enters a workpiece during a punching operation.

FIGS. 10–12 depict perspective views of the punching operation. A leadframe 10 is located above the dambar die 17 and beneath the punch 16 so that the dambar 15 to be removed from the leadframe 10 is precisely positioned between the punch face 18 and the die face 19 of the dambar die 17. The punch 16 is then brought down with great force, first pressing the punch face 18 downwardly against the leadframe 10 then, in the same stroke, continuing to drive the punch face 18 downwardly through the leadframe 10, past the die face 19, and into the opening of the dambar die 17. The dambar 15 is thereby cut and removed from the leadframe 10. The grooves 21 in the die face 19 of the dambar die 17 aid in preventing the slug 22 (i.e., the dambar that has been cut and removed from the leadframe 10) from adhering to the punch face 18 during the return stroke of the punch 16 up and out of the opening of the dambar die 17.

Figure 13:
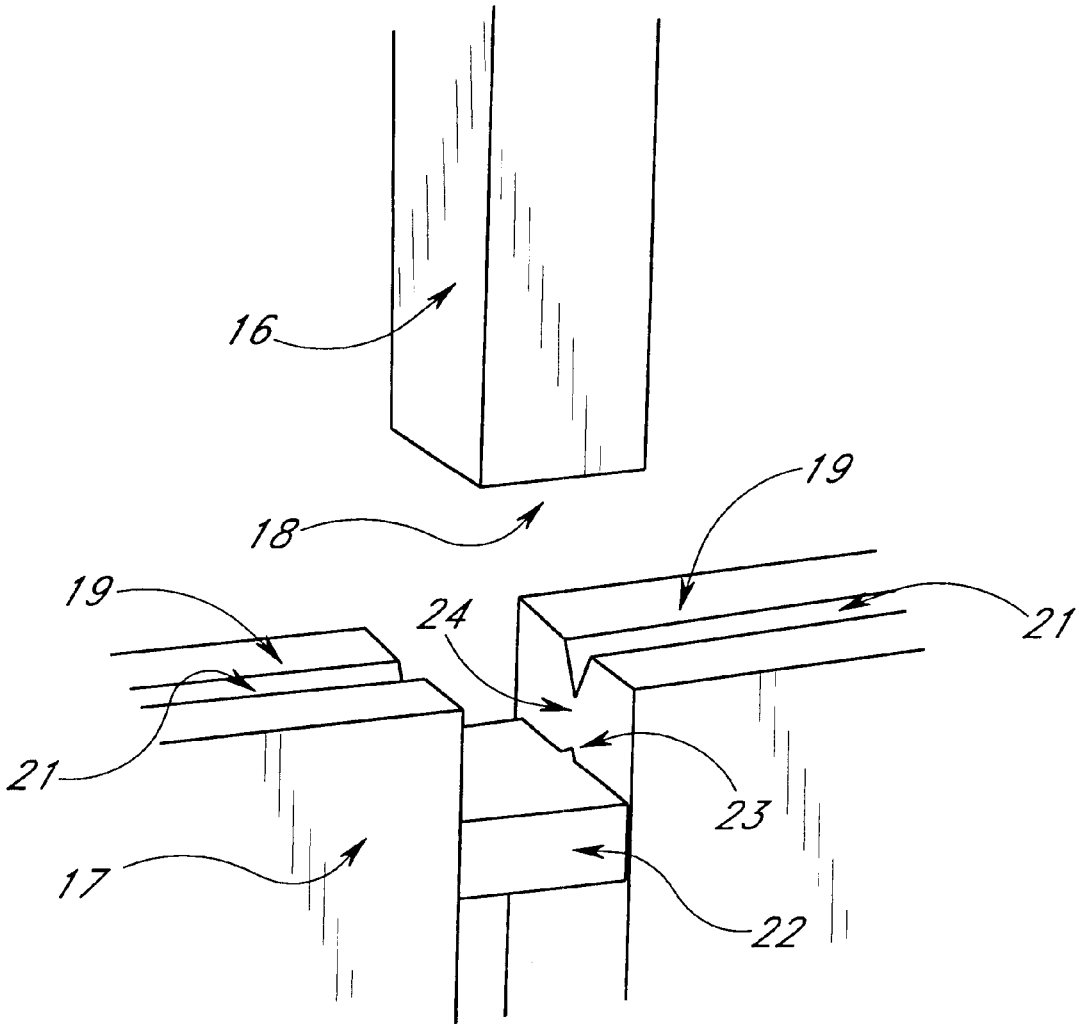
FIG. 13 is a perspective view of a punch and dambar die of the invention showing the slug retained in the die.

As the dambar 15 is cut from the leadframe 10 by the shearing force between the sharp punch face 18 and the sharp edge of the die face 19 of the dambar die 17, the groove 21 will cause the slug 22 to be formed with a small distortion 23 on its perimeter. (See FIG. 13.) The distortion 23 on the slug 22 will tend to jam against the wall 24 of the opening of the dambar die 17 so that, on the return stroke of the punch 16, the slug 22 will not follow or adhere to the punch face 18, but will remain in the opening of the dambar die 17 or will fall out of the bottom of the dambar die 17, the opening of which is slightly flared in the downward direction.

Figure 14:
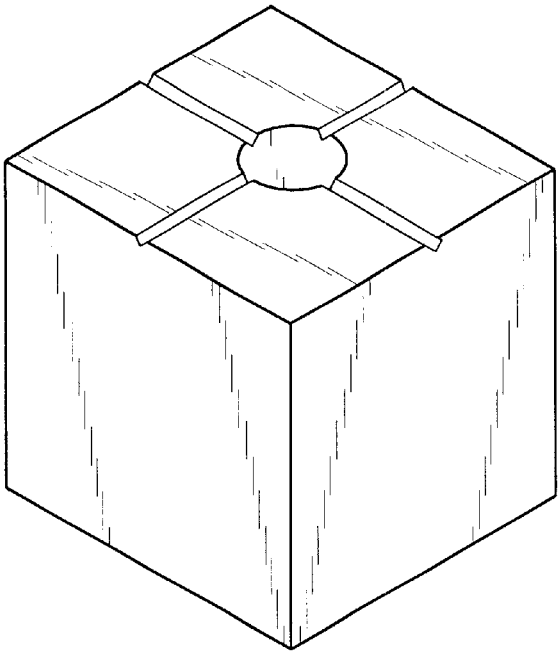
FIG. 14 is a perspective view of a die depicting an alternate embodiment of the invention.
Figure 15:
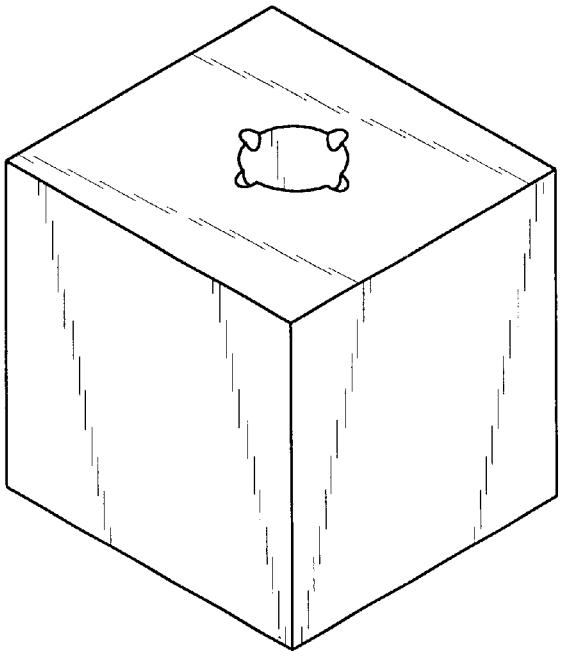
FIG. 15 is a perspective view of a die depicting another alternate embodiment of the invention.

It is, of course, possible to carve one, two, or more grooves in the die face of the dambar die and still enjoy the slug-retaining benefit of the invention. The grooves need not be V-shaped, but may be deeper or shallower, or wider or thinner, than the dimensions of the grooves in the preferred embodiment. In addition, the irregularity carved into the die face of the dambar die need not be a groove, as any depression in the top edge of the opening of the die may perform the desired function. Also, the die need not be a dambar die, but may be a die of any type, shape, or size. (See FIGS. 14 and 15.)

In addition, although this invention has been disclosed in the context of certain preferred embodiments and examples, it will be understood by those skilled in the art that the present invention extends beyond the specifically disclosed embodiments to other alternative embodiments or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A punch press for cutting and removing at least one dambar from a leadframe of an IC chip package and thereby for separating leads of the IC chip package, comprising:

a punch;

a punch face at an end of said punch having edges sufficiently sharp to cut through said leadframe of said IC chip package;

a dambar die having an opening for receiving said punch when said punch face is forcibly thrust downward against and through said leadframe when said leadframe is positioned between said punch and said dambar die, with the cross-sectional area of said opening sized to conform with said punch face; and a die face at a surface of said dambar die essentially parallel to said punch face, said die face having edges at said opening sufficiently sharp to cut through said leadframe and to remove said dambar therefrom and having one or more irregularities at said edges, said irregularities shaped to form a burr on said dambar cut and removed from said leadframe when said punch face is forcibly thrust downward against and through said leadframe and into said opening, wherein the one or more irregularities are V-shaped grooves cut into the die face and extending essentially perpendicular to a direction of movement of the punch.

2. The punch press of claim 1, wherein each of the V-shaped grooves has a width of approximately 0.10 millimeters and a depth of approximately 0.09 millimeters at the edges of the die face.

3. The punch press of claim 2, wherein the die face has two V-shaped grooves symmetrically formed at opposite edges of said die face.

4. A punch press for cutting a slug from a sheet of material, comprising:

a punch having a punch face; and die having a die face which includes an opening having edges which conform with said punch face throughout a length of said edges except at one or more locations at which said die face includes an irregularity shaped to form a burr on one edge of said slug, wherein one or more of the irregularities is a groove cut into one of the edges of the die face with said groove extending essentially perpendicular to a direction of movement of the punch.

5. The punch press of claim 4, wherein the edges of the die face have a plurality of irregularities.

6. The punch press of claim 4, wherein the groove is V-shaped.

* * * * *